US007395828B1

(12) United States Patent
Pulley

(10) Patent No.: US 7,395,828 B1
(45) Date of Patent: Jul. 8, 2008

(54) COLLAPSIBLE CHAIR UMBRELLA WITH SWIVEL SUPPORT SHAFT MOUNT

(76) Inventor: Carnell Pulley, 20 Granda St., Apt. D, Asheville, NC (US) 28806

( * ) Notice: Subject to any disclaimer, the term of this patent is extended or adjusted under 35 U.S.C. 154(b) by 249 days.

(21) Appl. No.: 11/412,480

(22) Filed: Apr. 28, 2006

(51) Int. Cl.

| | |
|---|---|
| ***A45B 3/00*** | (2006.01) |
| ***A45B 11/00*** | (2006.01) |
| ***A45B 17/00*** | (2006.01) |
| ***A47C 7/62*** | (2006.01) |
| ***F16C 11/06*** | (2006.01) |

(52) U.S. Cl. ..... 135/16; 297/184.16; 403/115

(58) Field of Classification Search ..... 135/15.1, 135/16, 20.1, 21; 297/184.15, 184.16; 403/91, 403/114, 115; 269/75

See application file for complete search history.

(56) References Cited

U.S. PATENT DOCUMENTS

| | | | | |
|---|---|---|---|---|
| 2,126,443 | A * | 8/1938 | Begley | 482/117 |
| 3,050,280 | A | 8/1962 | Regan | |
| 3,848,838 | A | 11/1974 | Thomas | |
| 4,809,724 | A | 3/1989 | Fuser | |
| 4,871,141 | A | 10/1989 | Chen | |
| 5,110,184 | A | 5/1992 | Stein et al. | |
| 6,082,694 | A * | 7/2000 | Joyce | 248/288.31 |
| 6,234,187 | B1 | 5/2001 | Izzo | |
| 6,942,256 | B2 * | 9/2005 | Amy | 292/100 |

* cited by examiner

*Primary Examiner*—David R Dunn
*Assistant Examiner*—Danielle N Jackson

(57) ABSTRACT

A collapsible chair umbrella with swivel support shaft mount, the umbrella with a canopy on one end of the support shaft and a cross member on the other, the cross member with a clip on each end for selectively attaching to a chair, preferably a lawn or beach chair or the like, the chair having two upright back supports is disclosed. The cross member further comprises a ball swivel with covered, spring assisted action for pivoting the invention's umbrella about the cross member, thereby aiding in elevation, transport, and convenience of the invention.

20 Claims, 4 Drawing Sheets

COLLAPSIBLE CHAIR UMBRELLA WITH SWIVEL SUPPORT SHAFT MOUNT

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Lawn chairs, beach chairs, and the like are typically used in a sunny environment where at least a measure of shade is often desirable. Normal shade giving devices are not always portable and, even when so, can be just one more item to transport and set up and take down. Continual changes in positioning of a chair or the shade device is usually necessary. It is therefore desirable to provide a device that is readily transportable, selectively included as a part of a chair, conveniently repositioned, fully adjustable, and assisted with regard to elevation of the shading device.

1. Field of the Invention

The present invention relates to umbrellas, and more specifically to a collapsible chair umbrella with swivel mount shaft support.

2. Description of the Prior Art

Prior art is replete with umbrellas and recreational chairs, with some devices including the joining of both. Limitations exist, though, in such combinations in the prior art. Designs of umbrella attachment differ greatly from the present invention. Also, the present invention offers multiple advantages not offered by the prior art.

U.S. Pat. No. 6,234,187 issued to Izzo on May 22, 2001 discloses an adjustable beach chair umbrella comprising an umbrella with a canopy and a rod and, unlike the present collapsible chair umbrella, is mounted to the top of the tubular frame of a beach chair's backrest. Such mounting appears to be less stable than the swivel shaft support shaft mount of the present invention. Furthermore, the umbrella adjustment mechanism appears to be less easily used to adjust an umbrella than the ball swivel mounting of the present invention.

U.S. Pat. No. 3,848,838 issued to Thomas on Nov. 19, 1974 discloses an umbrella mounting bracket adapted for mounting the standard of an umbrella on the top portion of a chair back rest. The device differs from the present invention in that it is a bracket only. Further, the bracket is not similar in design or function to the present invention. The bracket offers no assistance in elevation of an umbrella, nor does it offer the support swivel of the present invention.

U.S. Pat. No. 5,110,184 issued to Stein et al. on May 5, 1992 discloses a beach chair rotatably mounted to a spike. While such beach chair provides an umbrella which, unlike the present invention, cannot be swiveled in multiple directions.

U.S. Pat. No. 4,871,141 issued to Chen on Oct. 3, 1989 discloses an adjustable umbrella support which attaches to a tubular side frame of a beach chair and comprises two flexible components for adjusting the umbrella. However, unlike the present collapsible chair umbrella with swivel support shaft mount, the support is located on the side frame, the support is likely to get in the way of a user's arm when seated. Also, due to the support being located on the side frame, the bending umbrella may be positioned at least partially in front of a user's face. Unlike the present collapsible chair umbrella, the placement is uncomfortable and inconvenient.

U.S. Pat. No. 4,809,724 issued to Fuser on Mar. 7, 1989 discloses a sunshade holder for deck chairs and baby carriages which provides a U-shaped rod mounted on each tubular back rest side frame of a deck chair or baby carriage. Due to its side frame mounting, a user's arms may be pinched in the mounting devices when a user raises his or her arms outwardly and toward the back rest.

U.S. Pat. No. 3,050,280 issued to Regan on Aug. 21, 1962 discloses an umbrellas adapter for a folding chair which does not encompass an umbrella and which does not provide the more sturdy and wind-resistant dual mount design of the present invention.

While the above-described devices fulfill their respective and particular objects and requirements, they do not describe a collapsible chair umbrella with swivel mount shaft support that provides for the advantages of the present invention, therefore, a need exists for an improved collapsible chair umbrella with swivel mount shaft support. In this respect, the present invention substantially departs from the conventional concepts and designs of the prior art.

SUMMARY OF THE INVENTION

The general purpose of the collapsible chair umbrella with swivel mount shaft support, described subsequently in greater detail, is to provide a collapsible chair umbrella with swivel mount shaft support which has many novel features that result in an improved collapsible chair umbrella with swivel mount shaft support which is not anticipated, rendered obvious, suggested, or even implied by prior art, either along or in combination thereof.

In view of the foregoing disadvantages inherent in the known types of chair umbrellas now present in the prior art, the improved collapsible chair umbrella with swivel mount shaft support overcomes the above-mentioned disadvantages and drawbacks or the prior art.

As such, the general purpose of the improved collapsible chair umbrella with swivel mount shaft support, described subsequently in greater detail, is to provide a new and improved collapsible chair umbrella with swivel mount shaft support which has all of the advantages of the prior art mentioned heretofore and many novel features that result in an improved collapsible chair umbrella with swivel mount shaft support which is not anticipated, rendered obvious, suggested, or even implied by the prior art, either alone or in combination thereof.

To accomplish this, the present collapsible chair umbrella with swivel support shaft mount comprises an umbrella which is affixed to a chair, preferably a folding chair. Lightweight folding chairs are preferably used with the invention, along the invention is not limited to such. This preference exists due to the fact that the most useful venue for the invention is within recreational pursuits wherein lightweight folding chairs are most common. Beach activities, picnics, camping excursions, and other outdoor events lend themselves most readily to the advantages of the invention. Most chairs used for such pursuits are known for substantially parallel back supports and even adjustable back supports. The present invention is fastened to the back supports, either permanently or as a removable add-on. While attachment is preferably a semi-circular clip, numerous forms of attachment are utilized. The semi-circular clip is preferred due to selectively of permanence versus temporary attachment. The clip is offered in various sizes and shapes in order to fit a variety of chair back supports. For permanent attachment to a chair, the clip of the invention is attached via more than one method. Glue is selectively used for attachment, when permanence is desired. When the temporary application of the invention is chosen, the clips provide a snug fit around the chair back supports even without glue. The invention may also be welded to metal chair supports, or still even glued. Clips of the invention are offered in both square and round design, as example, so that both square and round chair back supports are properly fitted. Clips designed for square or rectangular back supported chairs are offered in two styles. One embodiment offers a small partial surround clip for engaging the side of a back support opposite the invention's crossmember. Another embodiment features interference fit around three sides of the back support. The preferred embodiment of the clip used for round chair back supports encircles a substantial diameter of the round back support, thereby engaging the support sufficiently to clamp the cross member to the chair. The invention is not limited to a particular material makeup of cross member or support shaft. A variety of materials are used for creating various examples of the invention. Among those are included metals, alloys, polymers, FRP's (fiberglass reinforced plastics), and the like. The clips provide, when needed to accommodate a particular chair makeup, flexibility whereby the interference fit of the cross member of the invention is enabled.

The uniqueness of the invention lies in the cross member clip design, the swivel ball of the cross member and support shaft mating, and the spring loading of the swivel for the support shaft. The invention's ball swivel also comprises, in one embodiment, a threaded aperture for the removable receipt of a threaded support shaft of the umbrella. The threaded aperture and support shaft provide for selective removal of the support shaft and canopy of the invention from the swivel ball and cross member. The cross member can remain engaged with the back supports of a chair, or removed. The spring force acts to elevate the support shaft to meet the chair back, thereby holding the umbrella in an elevated posture. This feature is enabled by the ball swivel of the cross member. The ball swivel is comprised of a ball housing. Immediately within the inner surface of the housing is an articulating surface. That surface is matched by a slightly smaller diameter outer articulating surface of the ball constrained within the housing. The housing is further comprised of a slot, which is preferably at least 180 degrees in duration about the center of the ball. The ball is further comprised of a threaded aperture for removable receipt of the umbrella support shaft. The threaded aperture corresponds with the slot. The support shaft of the umbrella pivots with the ball's rotation within the housing. Two methods of spring-assisted articulation of the ball are provided. The first method anchors the ball to the cross member and allows the cross member to articulate within the clip at each opposite end. The second method anchors the cross member to each opposite clip. The cross member then articulates within the ball. With either method, the springs on either side of the ball are anchored to assist rotation of the umbrella into the upward position. The springs are therefore anchored at each end of each of the springs. Each respective spring is wound in a direction opposite that of its counterpart.

Further, the springs are covered. Covering is either pliable or more rigid, such as with plasticized materials or metal. The support shaft often rests against the seat back of a chair in one embodiment, the shaft and canopy thereby supported in the elevated position by the seat back and spring tension of the springs. Another embodiment comprises a lock tab for holding the articulating ball of the ball swivel in the desired position.

Thus has been broadly outlined the more important features of the improved collapsible chair umbrella with swivel mount shaft support so that the detailed description thereof that follows may be better understood and in order that the present contribution to the art may be better appreciated.

These together with additional objects, features and advantages of the improved collapsible chair umbrella with swivel mount shaft support will be readily apparent to those of ordinary skill in the art upon reading the following detailed description of presently preferred, but nonetheless illustrative, embodiments of the improved collapsible chair umbrella with swivel mount shaft support when taken in conjunction with the accompanying drawings. In this respect, before explaining the current embodiments of the improved collapsible chair umbrella with swivel mount shaft support in detail, it is to be understood that the invention is not limited to its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the concept of this disclosure may be readily utilized as a basis for the design of other structures, methods, and systems for carrying out the several purposes of the improved collapsible chair umbrella with swivel mount shaft support. It is therefore important that the claims be regarded as including such equivalent constructions insofar as they do not depart from the spirit and scope of the present invention.

Objects of the improved collapsible chair umbrella with swivel mount shaft support, along with various novel features that characterized the invention are particularly pointed out in the claims forming a part of this disclosure. For better understanding of the improved collapsible chair umbrella with swivel mount shaft support, its operating advantages and specific objects attained by its uses, refer to the accompanying drawings and description.

It is therefore an object of the collapsible chair umbrella with swivel mount shaft support to provide an add-on umbrella to a chair.

It is also an object of the collapsible chair umbrella with swivel mount shaft support to provide a collapsible umbrella for a chair.

It is a further object of the collapsible chair umbrella with swivel mount shaft support to provide torsional force for assisting the elevation of the invention.

It is an added object of the collapsible chair umbrella with swivel mount shaft support to provide a cover for the torsional force.

It is still a further object of the collapsible chair umbrella with swivel mount shaft support to provide a unique swivel mount for the shaft support to cross member of the umbrella.

An added object of the collapsible chair umbrella with swivel mount shaft support is to provide for locking of the umbrella shaft in a selected position.

And, it is an object of the collapsible chair umbrella with swivel mount shaft support to provide for selective installation on a chair.

Thus has been broadly outlined the more important features of the collapsible chair umbrella with swivel mounts shaft support so that the detailed description thereof that follows may be better understood and in order that the present contribution to the art may be better appreciated.

Numerous objects, features and advantages of the collapsible chair umbrella with swivel mount shaft support will be readily apparent to those of ordinary skill in the art upon reading the following detailed description of presently preferred, but nonetheless illustrative, various embodiments of the collapsible chair umbrella with swivel mount shaft support when taken in conjunction with the accompanying drawings. In this respect, before explaining the current examples of the collapsible chair umbrella with swivel mount shaft support in detail, it is to be understood that the invention is not limited in its application to the details of construction and arrangements of the components set forth in the following description or illustration. The invention is capable of other examples and of being practiced and carried out in various ways. It is also to be understood that the phraseology and terminology employed herein are for purposes of description and should not be regarded as limiting.

Those skilled in the art will appreciate that the conception upon which this disclosure is based may readily be utilized as a basis for the design of other structures, methods and systems for carrying out the several purposes of the collapsible chair umbrella with swivel mount shaft support. It is therefore important that the claims be regarded as including such equivalent constructions insofar as they do not depart from the spirit and scope of the present invention.

Objects of the collapsible chair umbrella with swivel mount shaft support, along with various novel features that characterize the invention are particularly pointed out in the claims forming a part of this disclosure. For better understanding of the collapsible chair umbrella with swivel mount shaft support, its operating advantages and specific objects attained by its uses, refer to the accompanying drawings and description.

DETAILED DESCRIPTION OF THE DRAWINGS

With reference now to the drawings, and in particular FIGS. 1 through 5 thereof, examples of the employing the principles and concepts of the present invention and generally designated by the reference number 10 will be described.

Figure 1:
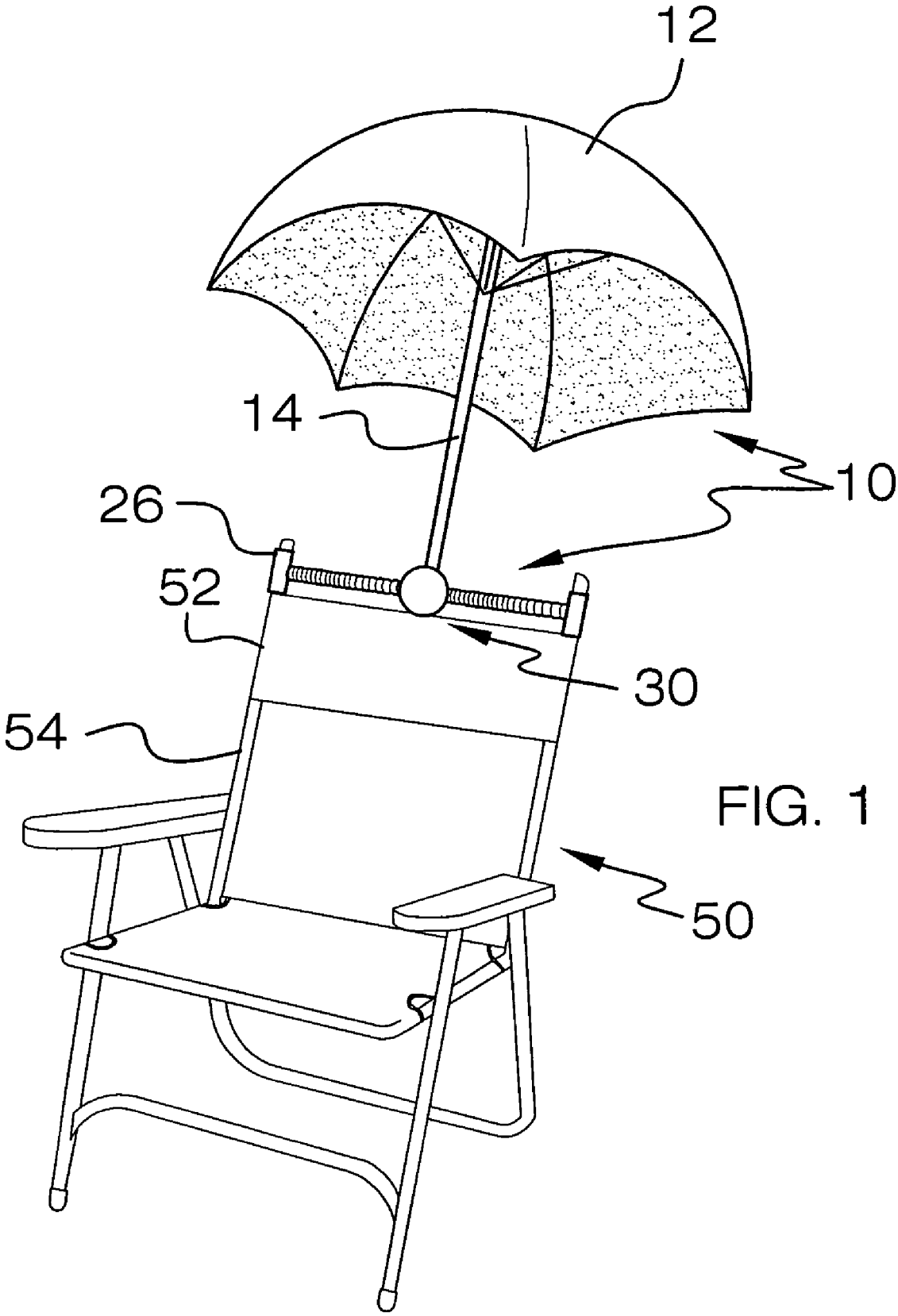
FIG. 1 is a perspective view installed on a chair, the canopy in the open position.
Figure 2:
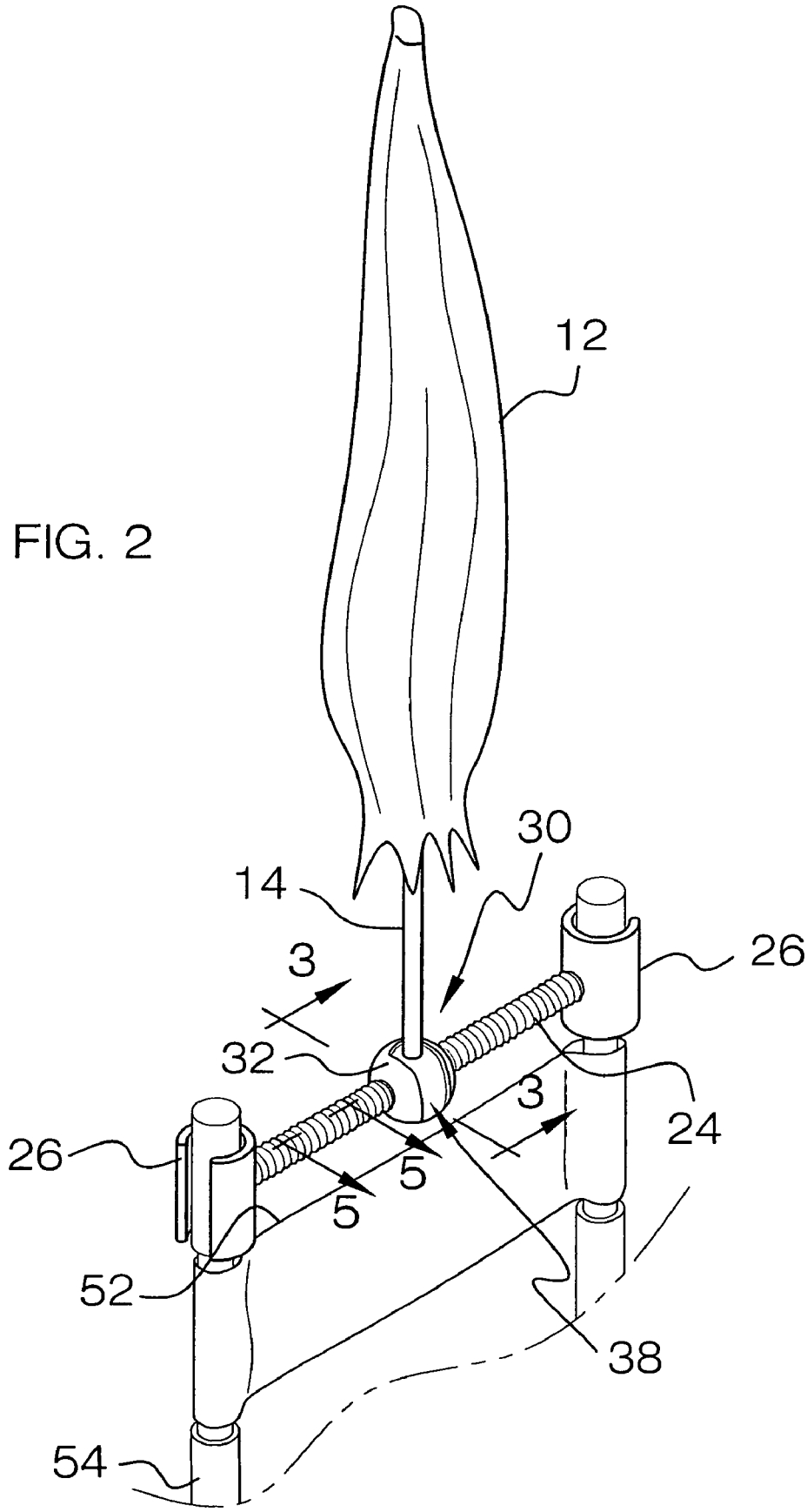
FIG. 2 is a close-up perspective view installed on the back supports of a chair, the canopy in the collapsed position.

Referring to FIGS. 1 and 2, the invention 10 comprises an umbrella which is affixed to a chair 50. The invention 10 further comprises a collapsible canopy 12 with a collapsibility control (not shown) for the canopy 12. The collapsibility control is well known in the art. The support shaft 14 of the invention 10 has a first end, a second end, and a length therebetween. The first end of the support shaft 14 is affixed to the canopy 12. Lightweight folding chairs 50 are preferably used with the invention 10, although the invention 10 is not limited to such. The invention 10 is fastened to the back supports 54 of the chair 50. The invention 10 is fastened either permanently or as a removable add-on. While attachment is preferably a semi-circular clip 26, numerous forms of attachment are utilized. The semi-circular clip 26 is preferred due to adaptability to permanence versus selective attachment of the invention 10. The clip 26 is offered in various sizes in order to fit a variety of chair 50 back supports 54. The clip 26 offers sufficient flexibility such that each clip 26 clips around the opposing back supports 54. For permanent attachment to a chair 50, the clip 26 of the invention 10 is attached via more than one method. Glue (not shown) is selectively used for attachment, when permanence is desired. When the temporary application of the invention 10 is chosen, the clips 26 provide a snug fit around the chair 50 back supports 54 even without glue. The clip 26 used for round chair 50 back supports 54 encircles a substantial diameter of the round back support 54, thereby engaging the support 54 sufficiently to clamp the cross member 16 to the chair 50. The ball swivel 30 is preferably disposed approximately midway between the clips 26 on the cross member 16. The springs 20 (FIG. 5) are disposed within spring covers 24. Spring covers 24 and springs 20 are disposed on either side of the ball swivel 30. The springs 20 provide dual function. The springs 20 push outwardly toward each opposing back support 54 of a chair 50. The springs 20 also provide spring 20 loaded assistance for elevating the invention 10 such that the mass of the umbrella canopy 12 and support shaft 14 and other components (not shown) are more easily handled by a user.

Figure 4:
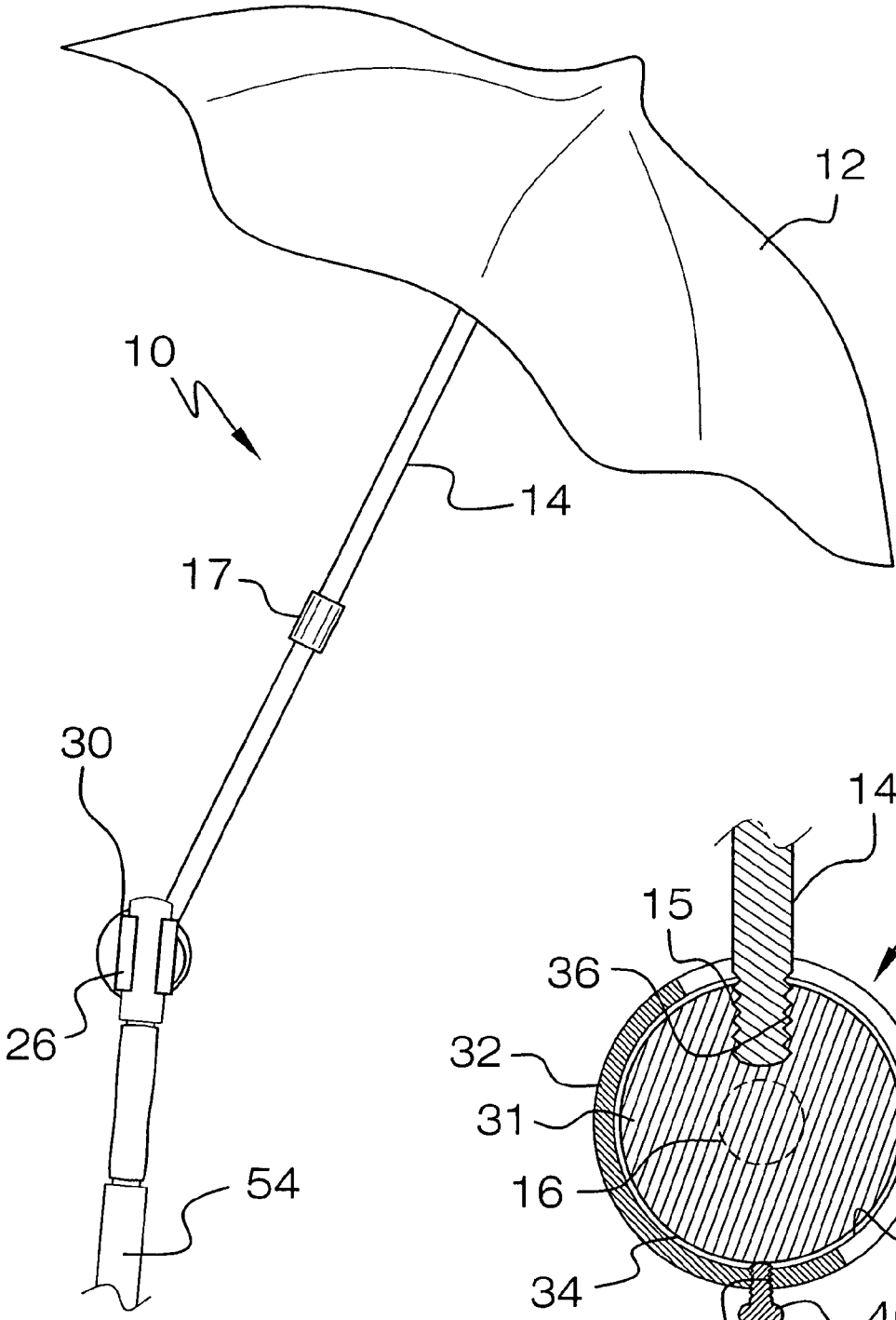
FIG. 4 is a side elevation installed on a chair.
Figure 3:
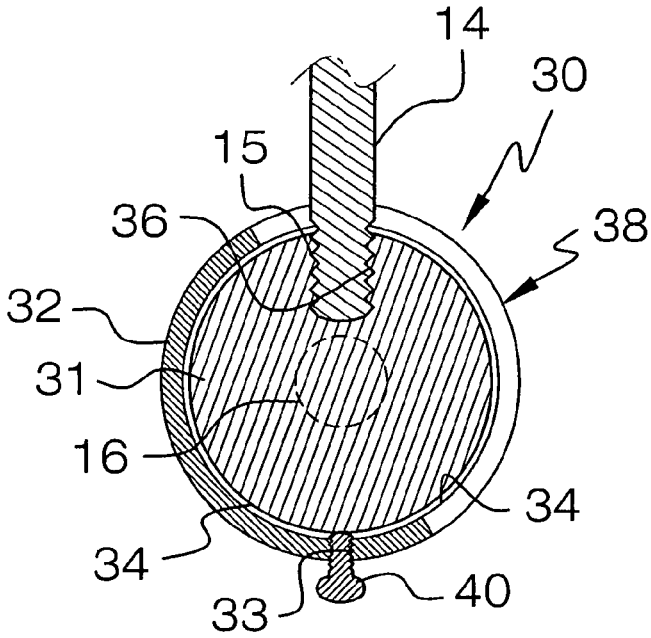
FIG. 3 is a cross sectional view of FIG. 2, taken along the line 3-3.
Figure 5:
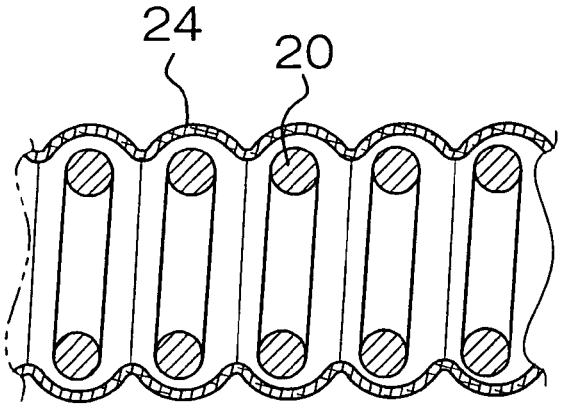
FIG. 5 is a cross sectional view of the spring and spring cover of FIG. 2, taken along the line 5-5.

Referring to FIGS. 3 and 4, the invention's 10 swivel ball joint, also referred to as ball swivel 30, offers a threaded aperture 36 for the removable receipt of the shaft thread 15 of the support shaft 14, thereby providing for selective removal of the support shaft 14 and canopy 12 of the invention 10 from the ball swivel 30. The cross member 16 can remain engaged with the back supports 54 of a chair 50, or removed. The spring 20 force acts to elevate the support shaft 14 to meet the seat back 52, thereby assisting in holding the umbrella in an elevated posture. This feature is enabled by the ball swivel 30. The ball swivel therefore provides pivot between the support shaft 14 and the cross member 16. The ball swivel 30 is partially comprised of a ball housing 32. Immediately within the inner surface of the housing 32 is an articulating surface 34. That surface 34 is matched by a slightly smaller diameter outer articulating 34 surface of the ball 31 constrained within the housing 32. The housing 32 is further comprised of a slot 38, which is preferably at least 180 degrees in duration about the center of the ball 31. The ball swivel 30 is disposed at an approximate center of the cross member 16. The ball 31 is further comprised of a threaded aperture 36 for removable receipt of the umbrella support shaft 14. The threaded aperture 36 corresponds with the slot 38.

The support shaft 14 of the invention 10 pivots with the ball's 31 rotation with the housing 32. Two methods of spring 20 assisted articulation of the ball 31 are provided. The first method, indicated in FIG. 3, anchors the ball 31 to the cross member 16 and allows the cross member 16 to articulate (not shown) within each clip 26 at each opposite end of the cross member 16. With either method, the springs 20 on either side of the ball 31 are anchored to assist rotation of the invention 10 into an upward position, with regard to the support shaft 14. The springs 20 are therefore anchored (not shown) at each end of each of the springs 20. One end of each spring 20 is anchored to the ball housing 32. The opposite end of each spring 20 is anchored to each of the opposite clips 26. Each respective spring 20 is wound in a direction opposite that of its counterpart. The springs 20 therefore assist against the mass of the umbrella, in elevating the umbrella to an upright position, as opposed to folded with a chair 50, as a part of a collapsing chair 50, for example. Further, the springs 20 are covered. Covering 24 is either pliable or more rigid, such as with plasticized materials or metal. The lock tab 40 is adjustably disposed within the housing thread 33 of the ball swivel 30 housing 32. The lock tab is tightened to hold the articulating ball 31 in the desired position. The lock tab 40 is loosened to allow pivot of the ball 31. The invention 10 can, therefore, be positioned, as illustrated in FIG. 4. The adjustment 17 provides for extension of the support shaft. As is also known in the art, the adjustment 17 can offer additional angular tilt (not shown) of part of the shaft 14. A canopy catch/release (not shown) is also provided.

Figure 6:
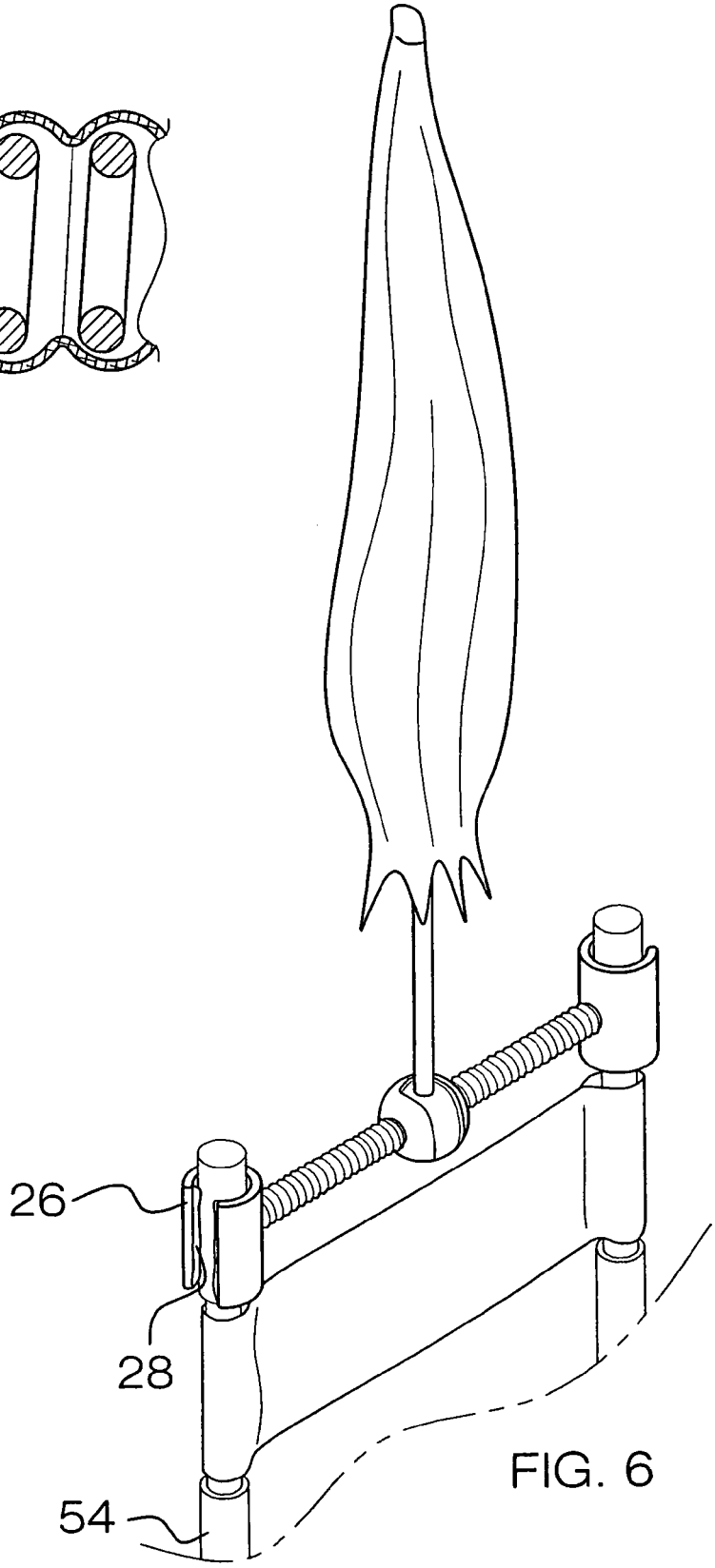
FIG. 6 is a perspective view of the clips welded to the back supports.

Referring to FIG. 6, an embodiment of the invention 10 employs clips 26 attached to the back supports 54 by welds 28.

With respect to the above description then, it is to be realized that the optimum dimensional relationships for the parts of the collapsible chair umbrella with swivel mount shaft support, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Directional terms such as "front", "back", "in", "out", "downward", "upper", "lower", and the like may have been used in the description. These terms are applicable to the examples shown and described in conjunction with the drawings. These terms are merely used for the purpose of description in connection with the drawings and do not necessarily apply to the position in which the present invention may be used.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A collapsible umbrella for attachment to spaced apart back supports of a chair, the umbrella and attachment comprising, in combination:

an umbrella, the umbrella having a mass;

a collapsible canopy of the umbrella;

a collapsibility control for the canopy;

a support shaft of the umbrella, the support shaft having a first end, a second end, and a length therebetween, the first end affixed to the canopy of the umbrella;

a horizontal cross member, the cross member having two opposite ends and a length therebetween;

securing means for securing the cross member to the back supports of the chair;

a ball swivel disposed at an approximate center of the cross member, the ball swivel comprised of:

a round exterior housing, the housing having an interior surface, an exterior surface, and a thickness;

a slot through the thickness of the exterior housing, the slot comprising at least 180 degrees of the housing circumference;

an articulating surface on an interior of the slot;

a ball within the interior of the housing, the ball of a slightly smaller diameter than a diameter of the interior surface of the ball swivel housing;

an articulating surface on an exterior of the ball;

means for removable attachment of the second end of the support shaft to the ball of the ball swivel;

means for securing the support shaft of the umbrella in a desired elevated position.

2. The umbrella in claim 1 wherein the support shaft is further comprised of means for extension and contraction of the length of the support shaft.

3. The umbrella in claim 2 wherein the support shaft further comprises a means for angular tilt of a part of the shaft.

4. The invention in claim 3 wherein the collapsibility control for the canopy is within the length of the support shaft.

5. The umbrella in claim 2 wherein the collapsibility control for the canopy is within the length of the support shaft.

6. The umbrella in claim 1 wherein the support shaft further comprises a means for angular tilt of a part of the shaft.

7. The invention in claim 6 wherein the collapsibility control for the canopy is within the length of the support shaft.

8. The umbrella in claim 1 wherein the collapsibility control for the canopy is within the length of the support shaft.

9. A collapsible umbrella for attachment to spaced apart back supports of a chair, the umbrella and attachment comprising, in combination:

an umbrella, the umbrella having a mass;

a collapsible canopy of the umbrella;

a collapsibility control for the canopy;

a support shaft of the umbrella, the support shaft having a first end, a second end, and a length therebetween, the first end affixed to the canopy of the umbrella;

male threads on the second end of the support shaft;

a horizontal cross member, the cross member having two opposite ends and a length therebetween;

securing means for securing the cross member to the back supports of the chair;

a ball swivel disposed at an approximate center of the cross member, the ball swivel comprised of:

a round exterior housing, the housing having an interior surface, an exterior surface, and a thickness;

a slot through the thickness of the exterior housing, the slot comprising at least 180 degrees of the housing circumference;

an articulating surface on an interior of the slot;

a ball within the interior of the housing, the ball of a slightly smaller diameter than a diameter of the interior surface of the ball swivel housing;

an articulating surface on an exterior of the ball;

a threaded aperture within the ball, the threaded aperture for the removable receipt of the threads of the support shaft;

a housing thread through the ball swivel housing;

a lock tab adjustably disposed within the housing thread;

a pair of spaced apart springs, each spring surrounding the cross member on an opposite side of the ball swivel, respectively, each spring of an opposite wind of the other, each spring anchored to a clip and the ball swivel housing, each spring assisting in elevation of the support shaft.

10. The umbrella in claim 9 wherein the support shaft is further comprised of means for extension and contraction of the length of the support shaft.

11. The umbrella in claim 10 wherein the collapsibility control for the canopy is within the length of the support shaft.

12. The umbrella in claim 10 wherein the support shaft further comprises a means for angular tilt of part of the shaft.

13. The umbrella in claim 12 wherein the collapsibility control for the canopy is within the length of the support shaft.

14. The umbrella in claim 9 wherein the support shaft further comprises a means for angular tilt of part of the shaft.

15. The umbrella in claim 14 wherein the collapsibility control for the canopy is within the length of the support shaft.

16. The umbrella in claim 9 wherein the collapsibility control for the canopy is within the length of the support shaft.

17. A collapsible umbrella for attachment to spaced apart back supports of a chair, the umbrella and attachment comprising, in combination:

an umbrella, the umbrella having a mass;

a collapsible canopy of the umbrella;

a collapsibility control for the canopy;

a support shaft of the umbrella, the support shaft having a first end, a second end, and a length therebetween, the first end affixed to the canopy of the umbrella;

means for extension and contraction of the length of the support shaft, the means for extension and contraction disposed within the length of the support shaft;

means for angular tilt of part of the shaft, the means for angular tilt disposed within the support shaft;

threads on the second end of the support shaft;

a horizontal cross member, the cross member having two opposite ends and a length therebetween;

a semi-circular clip on each of the opposite ends of the cross member, each clip removably securing the cross member to the chair;

a ball swivel disposed at an approximate center of the cross member, the ball swivel comprised of:

a round exterior housing, the housing having an interior surface, an exterior surface, and a thickness;

a slot through the thickness of the exterior housing, the slot comprising at least 180 degrees of the housing circumference;

an articulating surface on an interior of the slot;

a ball within the interior of the housing, the ball of a slightly smaller diameter than a diameter of the interior surface of the ball swivel housing;

an articulating surface on an exterior of the ball;

a threaded aperture within the ball, the threaded aperture for the removable receipt of the threads of the support shaft;

a pair of spaced apart springs, each spring surrounding the cross member on an opposite side of the ball swivel, respectively, each spring of an opposite wind of the other, each spring anchored to a clip and the ball swivel housing, each spring assisting in elevation of the support shaft.

18. The umbrella in claim 17 wherein the collapsibility control for the canopy is within the length of the support shaft.

19. The umbrella in claim 18 wherein the ball housing is further comprised of a housing thread.

a lock tab adjustably disposed within the housing thread.

20. The umbrella in claim 19 wherein each clip is welded to each back support, respectively.

* * * * *